US008326196B2

(12) United States Patent
Walsh

(10) Patent No.: US 8,326,196 B2
(45) Date of Patent: Dec. 4, 2012

(54) PNEUMATIC TRANSFER ASSIST BAFFLE

(75) Inventor: James D. Walsh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 968 days.

(21) Appl. No.: 12/135,515

(22) Filed: Jun. 9, 2008

(65) Prior Publication Data

US 2009/0304424 A1 Dec. 10, 2009

(51) Int. Cl.
*G03G 15/00* (2006.01)
*G03G 15/14* (2006.01)

(52) U.S. Cl. ..... 399/318; 399/297; 399/302; 399/312

(58) Field of Classification Search ..... 399/318
See application file for complete search history.

(56) References Cited

U.S. PATENT DOCUMENTS 3,977,779 A * 8/1976 Brooke ..... 399/318
5,300,993 A * 4/1994 Vetromile ..... 399/339
5,848,339 A * 12/1998 Costrop et al. ..... 399/298

* cited by examiner

*Primary Examiner* — Matthew G Marini
*Assistant Examiner* — Nguyen Q Ha
(74) *Attorney, Agent, or Firm* — Ronald E. Prass, Jr.; Prass LLP

(57) ABSTRACT

This is a baffle used in a transfer station of an electrophotographic marking system. The baffle has a series of air passages that, when these passages are opened, they apply pressure to a sheet of paper and push it upward against a belt or drum surface of a photoreceptor or photoconductor. The toner imaged photoreceptor then transfers the image to the paper that is in contact with it. From the transfer station, the paper with the transferred image is then moved to the fuser station where the image is fused to the paper.

The baffle with air passages does not scratch the photoconductor surface as do the prior art systems. Also, the baffle has a much longer useful life than the more costly lift finger transfer blades previously used.

A controller senses when a sheet enters the transfer station, senses the paper size, then activates a number of air passages to match the paper size.

17 Claims, 4 Drawing Sheets

PNEUMATIC TRANSFER ASSIST BAFFLE

This invention relates to electrostatic marking systems and, more specifically, to media transfer stations in such systems.

BACKGROUND

By way of background, in marking systems such as Xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to a final support material, such as paper, and the toner image is fixed thereto to form a permanent record corresponding to the original.

In these electrostatic marking systems, a photoreceptor belt or drum surface is generally arranged to move in an endless path through the various processing stations of the xerographic process sequentially, such as a charging station, an exposure station, a development station, a transfer station, a detack station, a fusing station, and a cleaning station (see FIG. 6 of this disclosure). Sometimes, as noted, the photoreceptor or photoreceptor surface is in the form of an endless belt and in other systems it is in the form of a drum. In this endless path, several xerographic-related stations are traversed by the photoconductive belt or drum, and become worn. Each of these belts is exposed to friction and moved by rollers that provide the belt movement to accomplish the belt purpose. Since the photoreceptor surface is reusable when the toner image is transferred to a final support material such as paper, the surface of the photoreceptor (PR) is constantly abraded and cleaned by a blade and/or brushes and prepared to be used once again in the marking process. The transfer process from the PR to paper uses mechanical devices, such as transfer assist blades which can also have adverse effects on the PR.

Transfer Assist Blades are devices which apply pressure to the back side of a sheet of media in the transfer zone of a xerographic printing machine. The pressure holds the media against the photoreceptor to improve the transfer of toner to the media. Transfer Assist Blades are mechanical devices that wear and require frequent replacement. These mechanical devices are moved in and out of a functional position as each sheet of paper enters and exits the transfer zone. If the device is in the functional position between sheets of media, the blade will become contaminated with toner from the inner document patches used for xerographic setups. This contamination can then be transferred to the back side of future media sheets, and this is an undesirable condition.

The function of the Transfer Assist Blade in the prior art is to apply a pressure to the back side of a media forcing it against the photoreceptor. This pressure is applied currently by forcing segments of the Transfer Assist Blade against the media by lifting specific segments with lifter fingers. The Transfer Assist Blade is comprised of many independent segments. The lifter fingers are also comprised of several independent fingers. These independent segments and fingers are activated based upon the width of the media currently being printed. If the media is narrower than the full process width, the inboard segments and lifter fingers are not engaged, as media enters the Transfer Zone. If they were activated, the blade segments would contact the photoreceptor causing scratches on the photoreceptor surface. These scratches would first cause potential defects in the customer prints once a full width media was being printed again. Second, the life of the photoreceptor would be reduced because of these scratches, driving up printing costs.

SUMMARY

This invention provides a baffle which has specific and independent air passages. These air passages can be opened and closed as the media or paper passes through the transfer zone of the xerographic printing machine. When opened, higher pressure air is applied to the back side of the media, forcing the media against the photoreceptor. During the inter document area, the passages can be closed, so not to disturb the xerographic setup patches. Without mechanically contacting the paper, there is less of a chance for the back side of the media to become contaminated, or that the PR can become worn because of contact with mechanical blades, etc.

Embodiments of this invention allow the user to simplify the current mechanically transfer actuated design by using a series of closely spaced air jets to apply pressure to the back side of the media in order to urge it against the PR during transfer. The proper number of air jets are actuated, depending on paper width, as determined by a paper width detector or a user input, as the transfer sheet enters the transfer zone and rapidly disabled as the sheet exits. The jets are silent as the media patches pass through transfer. The velocity and perhaps angle of the air jet can be optimized for paper weight, as determined by a paper weight detector or a user input, unlike the current mechanical transfer systems where no control of the transfer pressure is possible.

This present invention is a stationary transfer baffle with independent air outlets which can be independently activated. Independent activation allows for adjustment to match the width of the media currently being printed. There are many means for independently activating these air passages. Again, there are many shapes that would allow the proper function of this device. As the media enters the transfer zone, the activation of these air passages will provide a higher air pressure to the back side of a sheet of media. The high pressure on the back side of the media will cause a pressure differential between the front side and back side. This pressure differential will force the media against the photoreceptor in a similar fashion as the current mechanical system. Since this is a pressure differential producing the necessary force on the back side of the media, the mechanical positioning of the baffle can be further from the photoreceptor than the current mechanical system. The current mechanical system also has some binding issues which cause delays in the activation and de-activation of the transfer assist blade. Delays in de-activation can cause contamination of the blade, thus causing contamination of the back side of prints. It is believed the air baffle is a simpler design requiring fewer parts, thus reducing the cost, complexity and improving the reliability of the device. The current blade design also wears, requiring frequent replacement in the field. This new design would have no wearing component and therefore no replacement necessary.

The air transfer baffle of the present invention provides several advantages over the prior art lift fingers transfer blade. The present transfer baffle with air outlets provides a simpler design, improved reliability, reduced or eliminated toner contamination on the back of the paper, reduced manufacturing cost, easier to set up, and little abrasion effect or contamination of the PR. Prior art finger transfer blades are very expensive and need to be replaced often. In addition, the price of the PR belt is also very expensive and anything that prolongs the life of this belt such as the present invention is important.

DETAILED DESCRIPTION OF DRAWINGS AND PREFERRED EMBODIMENTS

Figure 1:
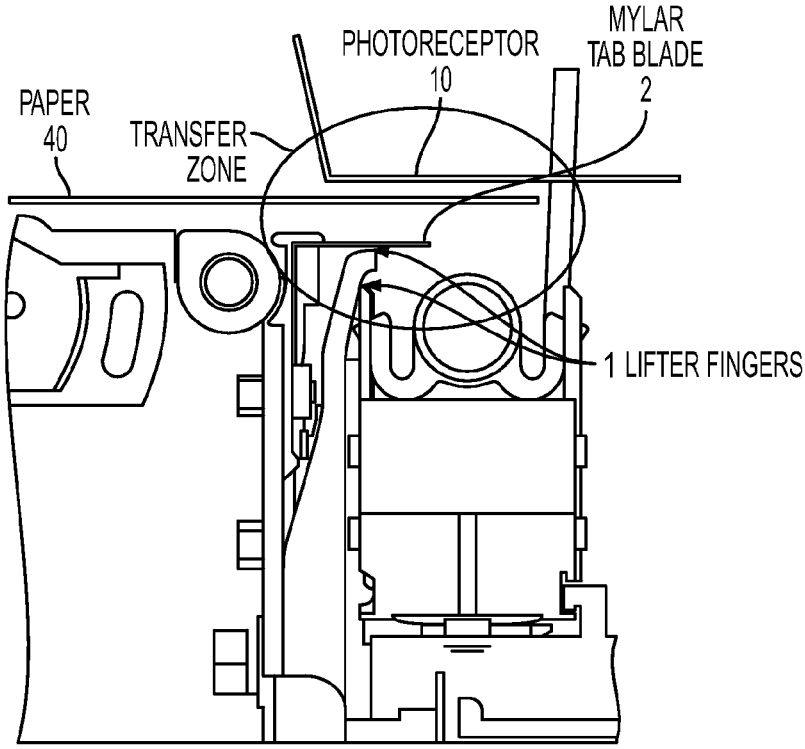
FIG. 1 PRIOR ART
FIG. 1 is a plan side view of the prior art lift fingers transfer assist blade (TAB) assembly.
Figure 2:
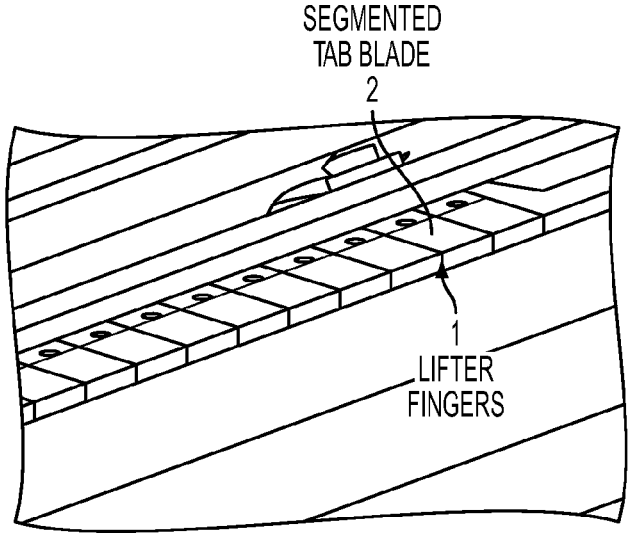
FIG. 2 PRIOR ART
FIG. 2 is a perspective view of the segmented blade lift finger structure of the prior art.

In FIG. 1 a paper sheet 40 is passed from the Registration baffle 48 (FIG. 3) to the transfer station D. At transfer station D, the prior art lifter fingers 1 and TAB Blade 2 are shown just prior to contact with the back of the paper 40 and prior to imaged photoreceptor 10 contact with the paper 40. Once the fingers lift into contact with the back of the TAB Blade the TAB Blade segments contact the back of the paper 40 the imaged toner from the PR 10 is transferred to the paper 40. Once transfer takes place, the fingers 1 and TAB blade 2 are retracted and the paper then is transported to the fusing station F to form a permanent image on paper 40. The prior art segmented blade 2 with movable lifter fingers 1 is shown in FIG. 2. The function of this prior art transfer blade 2 is to apply pressure to the back of paper 40 forcing it against the PR belt 10. This pressure is applied by forcing segments of fingers 1 against the back side of the TAB Blade 2 which then contact the back side of paper 40. The lifter fingers 1 and TAB blade 2 are comprised of many independent segments. When activated, the TAB Blade 2 often contact the PR surface causing scratches on the PR surface 10. These scratches cause potential defects on the final print. The life of the PR is significantly reduced because of these scratches, driving up printing costs for replacement PR belts 10 (or drums).

Figure 3:
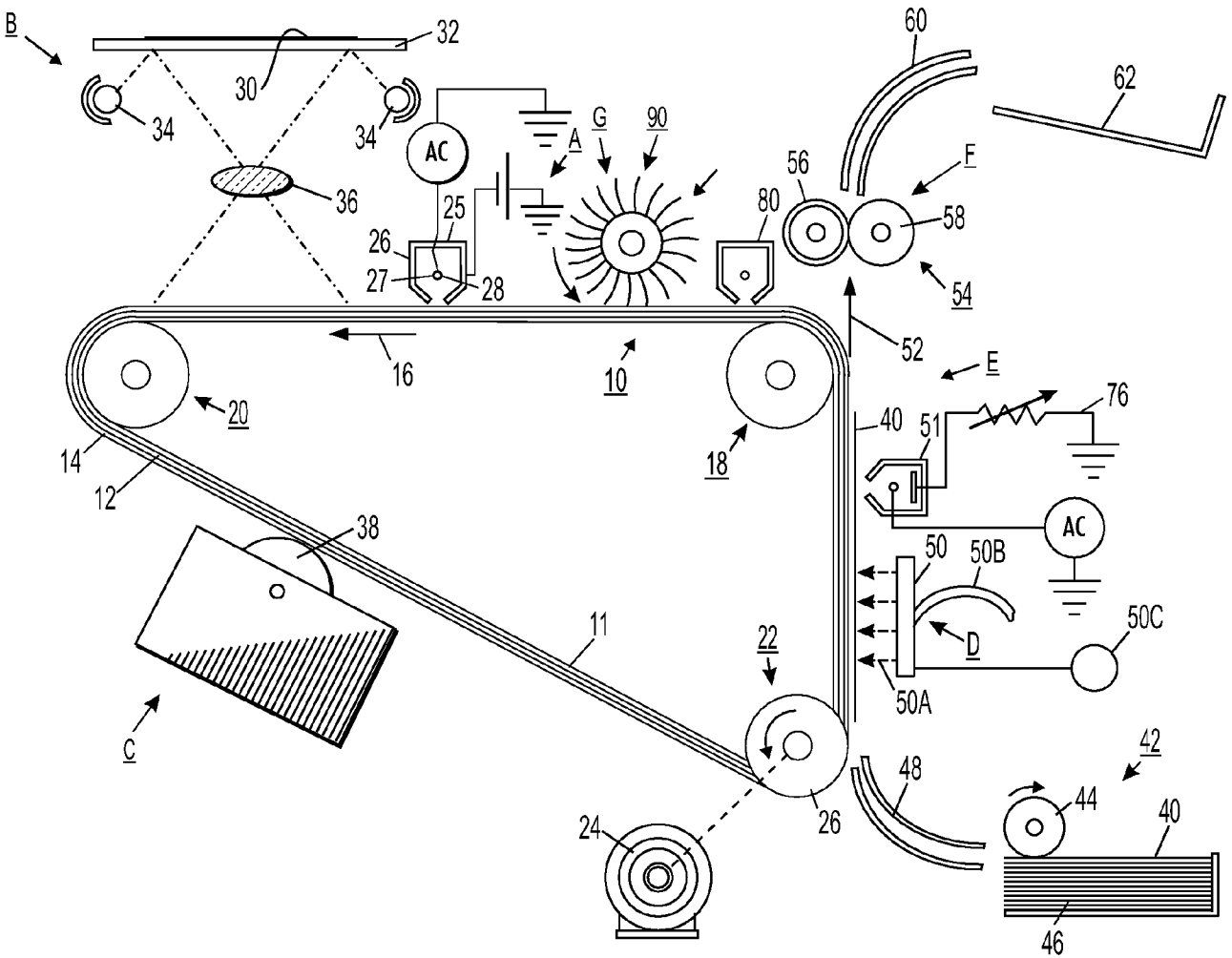
FIG. 3 is a schematic side view of a belt version of an electrostatic marking system, comprising the air outlet transfer baffle of an embodiment of this invention.
Figure 4:
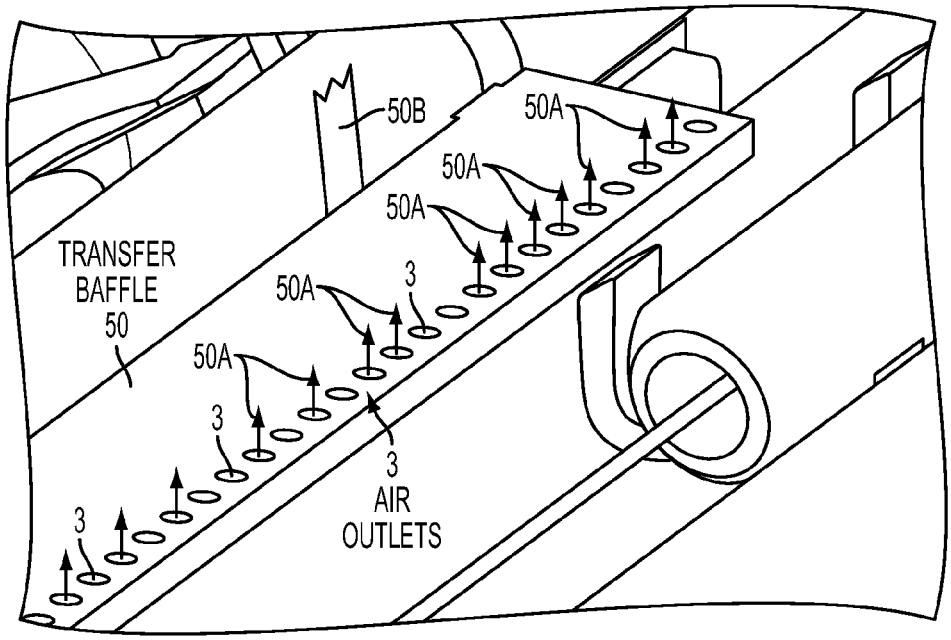
FIG. 4 is a close-up view of the air outlet transfer baffle of an embodiment of this invention.

In FIG. 3, the marking system using the transfer baffle 50 of this invention is shown. The baffle 50 has air jets 50A that force the paper 40 against the PR surface 10 to transfer the toned image on the PR 10 to the paper 40. A suitable source of air 50B supplies air to the baffle 50 so that a continuous air source is available to baffle 50 when baffle 50 is activated. In FIG. 4 a close-up view of baffle 50 with air outlets 3 is shown.

Figure 5:
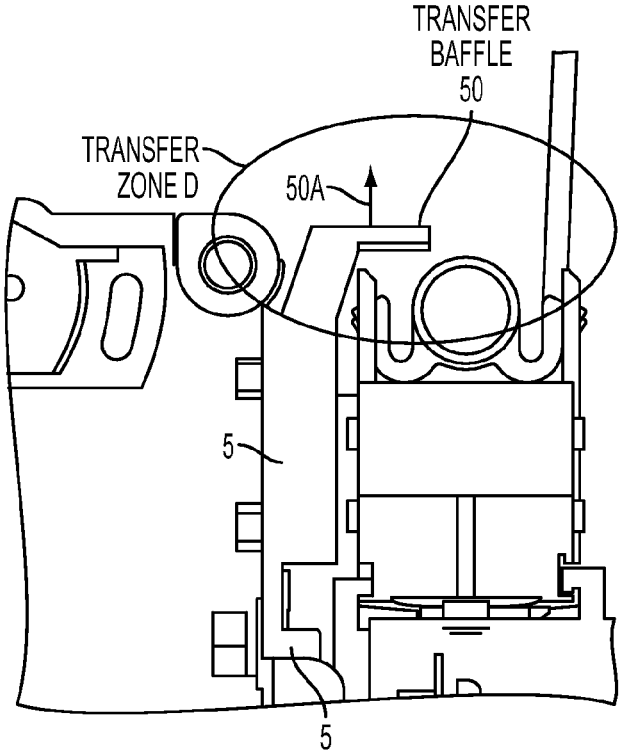
FIG. 5 is a plan side view of the transfer baffle assembly of this invention.

Shown in FIGS. 4 and 5 of this invention is a stationary transfer baffle 50 with independent air outlets 3 which can be independently activated. Independent activation allows for adjustment to match the width of the paper media currently being printed, as determined by a paper width detector or a user input. There are many means for independently activating these air passages when air is supplied by air source 50 B. Again, there are many air outlet 3 shapes that would allow the proper function of this device so that the velocity and air jet angle may be modified based on a paper weight determined by a paper weight detector or user input. As media 40 enters the transfer zone D, the activation of these air passages will provide a higher air pressure 50A to the back side of a sheet of media 40. The high pressure on the back side of the media will cause a pressure differential between the front side and back side. This pressure differential will force the media 40 against the photoreceptor 10 in a similar fashion as the current prior art mechanical system. Since this is a pressure differential producing the necessary force on the back side of the media, the mechanical positioning of the baffle can be further from the photoreceptor 10 than the current prior art mechanical system. The current mechanical prior art system also has some binding issues which cause delays in the activation and deactivation of the transfer assist blade 2. Delays in deactivation can cause contamination of the blade 2 thus causing contamination of the back side of prints. It is believed the air baffle of the present invention is a simpler design requiring fewer parts thus reducing the cost, complexity and improving the reliability of the device. The current prior art blade design also wears, requiring frequent replacement in the field. The present air baffle structure would have no wearing mechanical component such as TAB Blade 2 of the prior art but rather uses only air. No component TAB Blade replacement is necessary. Air jets 50A from Baffle 50 lifts paper 40 in position. For clarity, not all of air jets 50A are shown activated. The amount of air jets activated depends upon the size of the paper 40.

Figure 6:
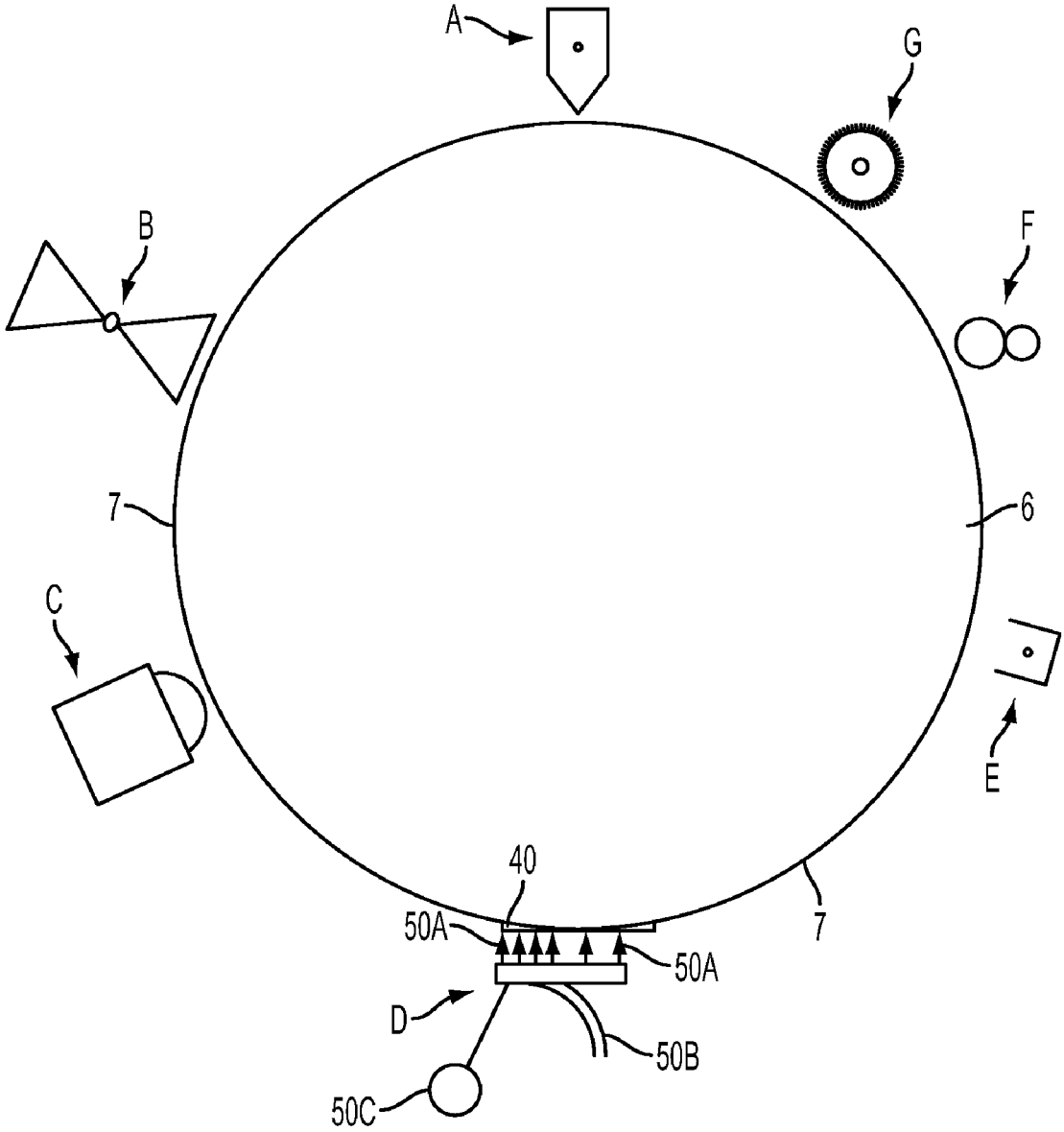
FIG. 6 is a schematic side view of a drum version of an electrostatic marking system comprising the air outlet transfer baffle of an embodiment of this invention.

This invention offers the following advantages:

1. simpler design
2. improved reliability
3. reduced/eliminated contamination
4. reduced manufacturing cost
5. easier setup
6. reduced run cost
7. reduced field service time In FIG. 6, a simplified schematic of a marking system using a photoconductive drum 6 is shown having the transfer baffle 50 of this invention at the transfer station D. The baffle 50 has air jets 50A that force the paper 40 against the PR (drum) 6 and its surface 7 to transfer the toned image on the drum surface 7 to the paper 40. A suitable source of air 50B supplies air to the baffle 50 so that a continuous air source is available to baffle 50 when baffle 50 is air activated by controller 50C. These air jets 50A cannot scratch the PR drum 6 surface 7 as do the TAB Blade 2 of the prior art.

In summary, embodiments of the present invention provide an electrophotographic marking system comprising sequentially positioned process stations, a charging station, an exposure station, a development station, a transfer station and a fusing station where the transfer station comprises an air jet transfer baffle configured to force a paper sheet against an imaged photoconductive surface by forcing air against a back non-image receiving paper surface.

The air is forced through air outlets in the baffle and is configured to be opened or closed by a controller depending upon a size and/or weight of paper being fed into the transfer station.

The baffle, as noted, is in contact with a controller. The controller is enabled to sense a size of the paper and to control the air outlets to be opened or closed in accordance with the paper size.

When all of the air outlets corresponding to a paper size are opened, a higher air pressure is applied to the back paper side thereby forcing the paper against the photoreceptor and enabled to transfer a toned image from the photoreceptor to the adjacent paper. The baffle has an upper surface having a structure contour conforming to an adjacent contacted surface structure of the photoreceptor.

The air outlets are positioned across substantially the entire length of the baffle. The baffle is in contact with a controller to determine which and how many air outlets are opened to accommodate various size paper. The baffle is in operative contact with a source of air. The baffle has a plurality of independently operated air outlets.

As noted earlier, the controller is configured to permit allocation of air through the air outlets to match the width or length of the paper media being printed. The controller contains a sensor that will sense an entrance of the paper into the transfer station and will cause the controller to activate the baffle.

The photoconductive surface of the marking system is either a photoconductive belt or a photoconductive drum. The embodiments of the present invention further provide an air pressure producing baffle configured for use in a transfer station of an electrophotographic marking system. The baffle comprises air outlets on a baffle face which is adjacent to a photoconductive surface in the marking system. The baffle is in operative connection to a baffle controller. The controller is enabled to sense a presence of a paper media sheet in the transfer station and subsequently is enabled to activate the baffle so that air jets will pass through the air outlets and contact a back face of the paper and thereby force the paper against a toned imaged surface of the photoconductor.

All of the air outlets in this baffle are configured to correspond to a paper size and when opened, a higher air pressure is applied to the back paper side thereby forcing the paper against the photoreceptor and is enabled to transfer a toned image from the photoreceptor to the paper.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system comprising:
one or more sequentially positioned process stations;
a charging station;
an exposure station;
a development station;
a transfer station that comprises an air jet transfer baffle configured to force a paper sheet against a photoconductive surface by forcing air through one or more air outlets in said baffle against a back non-image receiving paper surface of the paper sheet;
a fusing station;
a paper sheet size determination unit;
a paper weight determination unit; and
a controller configured to control the baffle to open or close the one or more outlets and to adjust the angle and velocity of the air forced through the air outlets,
wherein said air outlets are configured to be opened or closed based, at least in part, on a determined size of the paper sheet, and an angle and velocity of the air forced through the air outlets are based, at least in part, on a determined paper weight of the paper sheet.

2. The marking system of claim 1, wherein when all of said air outlets corresponding to the determined paper sheet size are opened, a higher air pressure is applied to said back paper surface of the paper sheet thereby forcing said paper against said photoconductive surface and enabling a transfer of a toned image from said photoconductive surface to said paper sheet.

3. The marking system of claim 1, wherein said baffle has an upper surface having a structure contour conforming to a contacted surface structure of said photoconductive surface.

4. The marking system of claim 1, wherein said baffle is in operative contact with a source of air.

5. The marking system of claim 1, wherein said baffle has a plurality of independently operated air outlets.

6. The marking system of claim 1, wherein the determined size of the paper sheet has a width and a length, and the controller is configured to permit an allocation of air through said air outlets to match the width or length of the paper sheet.

7. The marking system of claim 1, wherein said photoconductive surface is a photoconductive belt.

8. The marking system of claim 1, wherein said photoconductive surface is a photoconductive drum.

9. The marking system of claim 1, wherein said air outlets are positioned across substantially an entire length of said baffle, and said baffle is in contact with the controller to determine which and how many air outlets are to be opened to accommodate various sizes of paper sheets.

10. The marking system of claim 9, wherein said controller comprises at least a sensor configured to sense an entrance of said paper sheet into said transfer station, a size of the paper sheet, and a weight of the paper sheet, and cause said controller to activate said baffle accordingly.

11. An air pressure producing baffle for use in a transfer station of an electrophotographic marking system, said baffle comprising air outlets on a baffle face adjacent to a photoconductive surface in said marking system, said marking system comprising:
a paper sheet size determination unit; and
a paper weight determination unit,
wherein said baffle is in operative connection to a baffle controller configured to determine a presence of a paper media sheet in said transfer station to activate said baffle based, at least on part, on the determined presence of the paper media sheet to cause, at least in part, air to pass through said air outlets and onto a back face of said paper media to thereby force said paper media sheet against a toned imaged surface of said photoconductive surface, and
said controller is configured to permit an allocation of air through said air outlets to match a determined size of the paper media sheet in said transfer and cause, at least in part, an angle and velocity of said air passed through said air outlets to be based, at least in part, on a determined paper weight of the paper sheet.

12. The baffle of claim 11, wherein when all of said air outlets corresponding to the determined size of the paper media sheet are opened, a higher air pressure is applied to said back face of said paper media sheet thereby forcing said paper media sheet against said photoconductive surface and enable a transfer of a toned image from said photoconductive surface to said paper media sheet.

13. The baffle of claim 11, wherein said baffle has an upper surface having a structure contour conforming to a contacted surface structure of said photoconductive surface.

14. The baffle of claim 11, wherein said air outlets are positioned across substantially an entire length of said baffle, and said baffle is in contact with said controller to determine which and how many air outlets are to be opened to accommodate various sizes of paper media sheets.

15. The baffle of claim 11, wherein said baffle is in operative contact with a source of air.

16. The baffle of claim 11, wherein said baffle has a plurality of independently operated air outlets.

17. The baffle of claim 11, wherein said controller comprises a sensor configured to sense an entrance and size of said paper media sheet into said transfer station, a size of the paper sheet, and a weight of the paper sheet, and cause said controller to activate said baffle accordingly.

* * * * *